United States Patent [19]

Kim

[11] Patent Number: 4,825,985

[45] Date of Patent: May 2, 1989

[54] GARMENT CARRIER

[75] Inventor: Hyun S. Kim, New Castle, Pa.

[73] Assignee: Airway Industries, Inc., Ellwood City, Pa.

[21] Appl. No.: 98,060

[22] Filed: Sep. 17, 1987

[51] Int. Cl.[4] ..... A45C 5/12; A45C 13/00; A45C 13/10; B65D 85/18

[52] U.S. Cl. ..... 190/111; 190/112; 206/278; 206/287.1

[58] Field of Search ..... 206/278, 287, 287.1; 190/13 F, 109, 110–113; 150/116; 383/38–40

[56] References Cited

U.S. PATENT DOCUMENTS

| | | | |
|---|---|---|---|
| D. 267,677 | 1/1983 | Pelavin | 206/287.1 X |
| 1,416,415 | 5/1922 | Rauchbach | 190/13 F |
| 2,138,202 | 11/1938 | Wilt | 190/109 X |
| 2,496,128 | 1/1950 | Lifton | 190/111 |
| 2,606,636 | 8/1952 | Braverman | 206/287 X |
| 2,774,450 | 12/1956 | Smallberg | 206/287.1 X |
| 2,821,295 | 1/1958 | Marks | 383/40 X |
| 2,839,167 | 6/1958 | Smith | 190/108 |
| 2,841,257 | 7/1958 | Dallas | 190/115 X |
| 3,126,076 | 3/1964 | Koffler | 206/287.1 |
| 3,175,658 | 3/1965 | Bierman | 190/112 X |
| 3,273,678 | 9/1966 | Koret | 206/287 X |
| 3,612,232 | 10/1971 | Larson | 206/287 |
| 3,831,740 | 8/1974 | Pendergast et al. | 206/287 X |
| 4,030,268 | 6/1977 | Lugash | 190/18 A X |
| 4,613,039 | 9/1986 | Shaw et al. | 206/287.1 |
| 4,753,342 | 6/1988 | Pulichino, Jr. et al. | 206/287.1 X |

FOREIGN PATENT DOCUMENTS

| | | | |
|---|---|---|---|
| 199326 | 8/1958 | Fed. Rep. of Germany | 190/111 |
| 378477 | 7/1964 | Switzerland | 190/111 |
| 437876 | 11/1935 | United Kingdom | 190/109 |

*Primary Examiner*—Sue A. Weaver
*Attorney, Agent, or Firm*—Walter J. Blenko, Jr.; Suzanne Kikel

[57] ABSTRACT

A foldable garment carrier bag with a central chamber for suits or dresses closed by a cover with a zipper. A flap containing several pockets on both of its sides is sewn into the bottom welting and, a side pocket is formed and sewn into the welting on the two opposed sidewalls adjacent the flap.

14 Claims, 7 Drawing Sheets

GARMENT CARRIER

BACKGROUND OF THE INVENTION

1. Field of the Invention

This invention relates to a valet or garment carrier bag for carrying such garments as suits, dresses, etc., and in particular to a novel multi-compartment bag having a plurality of pockets on an inside flap, along the sidewalls, and on an inside wall of the bag.

2. Description of the Prior Art

Foldable garment bags of varying constructional features including a central chamber have been provided with emphasis on the details thereof which relate to suspending and carrying full length garments such as coats, suits, dresses, and the like basically in a central chamber. Such garment bags are exemplified in U.S. Pat. Nos. 2,839,167; 2,841,257; 3,273,678; 3,512,621; 3,612,232; and 4,030,768.

Other foldable garment bags have been provided with emphasis on a particular design consisting of an attachable pouch and a plurality of pockets on both the front and rear walls thereof as exemplified in U.S. Pat. De. No. 267,677.

In addition, some foldable garment bags are designed such as to contain zippered pockets on the outer front walls, such as exemplified in the above U.S. Pat. No. 2,839,167.

SUMMARY OF THE INVENTION

It is a broad object of my invention to provide a foldable garment bag with a central chamber and containing a plurality of inside and outer pockets and/or compartments which are easily accessible for packing and unpacking personal articles when the bag is either in an unfolded or in a folded disposition.

It is a further object of my invention to provide an improved foldable garment bag of the central chamber type for carrying full length coats, suits, or dresses, and having pockets easily accessible in the sidewalls for packing shoes, toilet articles, and incidental clothing.

I provide a unique pocket feature whereby the user of the garment bag can reach inside the bag to retrieve items from the pockets without havng to open the bag.

It is a still further object of the invention to provide a novel, simple, and inexpensive means and manner for forming and attaching these pockets into the structure of the garment bag.

I utilize the welting around the periphery and along both sides of the garment bag for attaching the open edges of the side pockets which are expandable, and for attaching a flap means with several pockets on opposite sides thereof into a central chamber of the garment bag in a manner the flap means lies adjacent to the side pockets when the bag is closed.

It is still a further object of my invention to provide an outer cover for closing the central chamber which is capable of being separated into two sections for easy access therein when in an unfolded disposition and particularly to provide easy access to the multi-pocketed flap means without having to fully open the central chamber.

Other details of the improvements which I provide in a foldable garment bag will become apparent in the subsequent description thereof when read in conjunction with the accompanying drawings, wherein:

DESCRIPTION OF A PREFERRED EMBODIMENT

Figure 1:
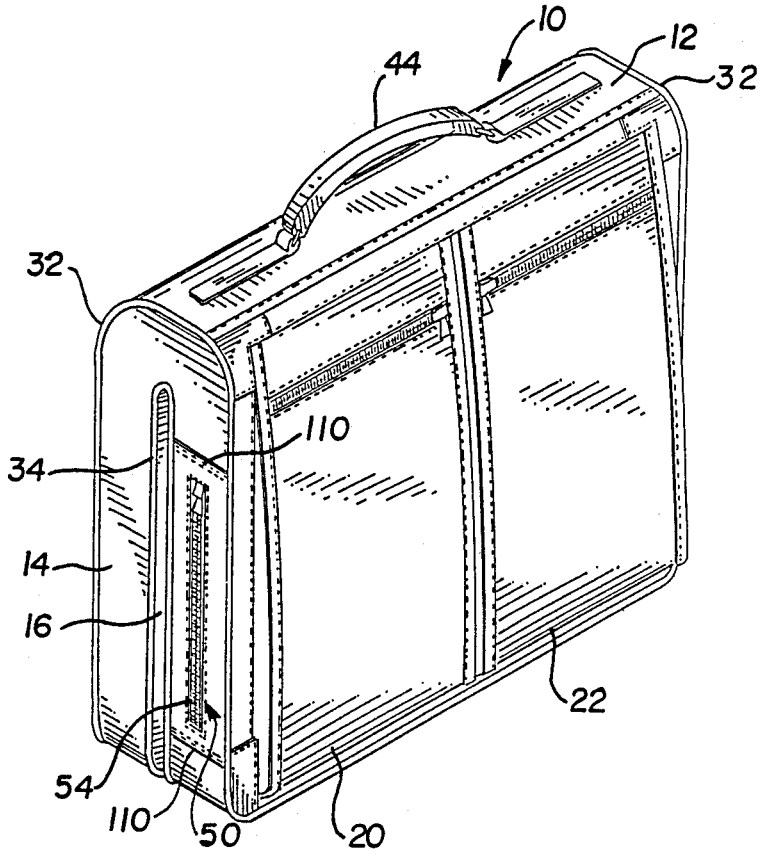
FIG. 1 is a perspective view of a preferred embodiment of my improved garment carrier bag in a closed and folded disposition.

Referring to the drawings, particularly FIGS. 1, 2, 4, 5, 8, and 9, there is shown a garment carrier bay 10 of the foldable, hangable type in which my invention is illustratively embodied. The bag 10 shown comprises a front or outer wall means 12, sidewalls or gusset means 14, and rear or inner wall means 16, which components cooperate to form a central chamber 18 as particularly shown in FIGS. 8 and 9. Central chamber 18 houses garments and includes means for carrying these garments such as coats, dresses, suits, etc. in an extended disposition in a conventional manner.

Both outer wall means 12 and gusset means 14 are similarly layered with generally two different types of suitable flexible material with an outer layer made of a heavy durable textured fabric sheet of material such as cloth, canvas or leather and an inner layer of a thinner, smoother sheet of material, such as vinyl or plastic. Inner wall means 16 also consists of two layers, with an inner layer a portion of which is shown at **16*a* (FIG. 9) being either vinyl or plastic and cooperating with the vinyl or plastic sheet of the inner layers for the outer-wall means 12 and gusset means 14 to line the central chamber 18 when garment bag 10 is closed and to form an inner wall for pockets 20, 22, 24 on the outer wall means 12 particularly shown in FIG. 3 and for pockets 26, 28, 30 on the inner wall means 16 particularly shown in FIG. 2**.

As shown in the several drawings, welting 32 extends peripherally along the seam line between outerwall means 12 and gusset means 14, and welting 34 extends peripherally along the seam line between inner wall means 16 and gusset means 14.

Figure 3:
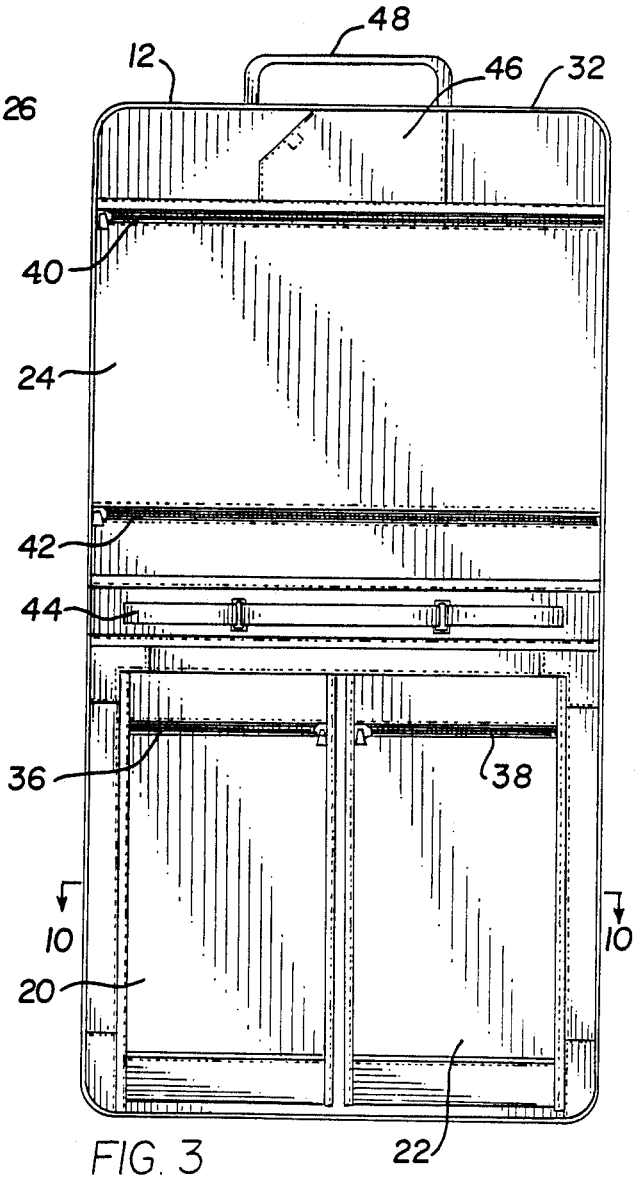
FIG. 3 is a rear elevational view of another wall of the garment bag when in an unfolded disposition; which wall is opposite to that shown in FIG. 2.
Figure 5:
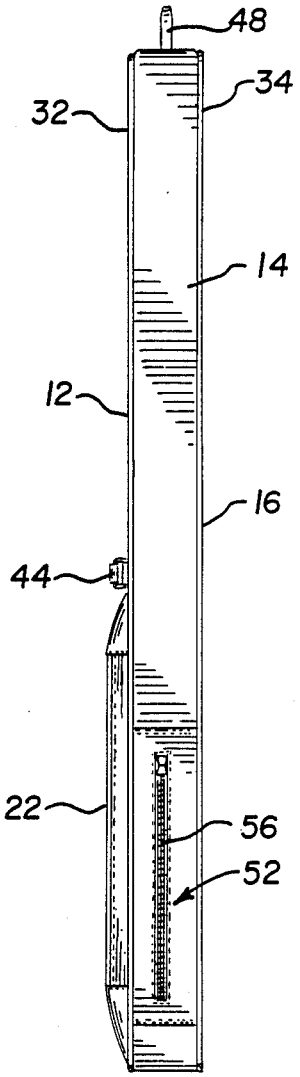
FIG. 5 is a right side view of FIG. 3.
Figure 6:
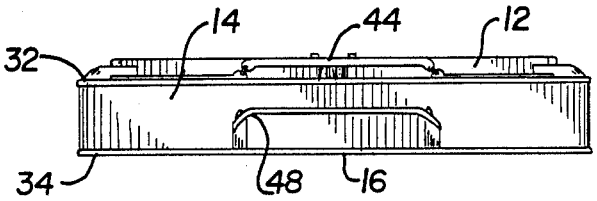
FIG. 6 is a top plan view of FIG. 3.
Figure 7:
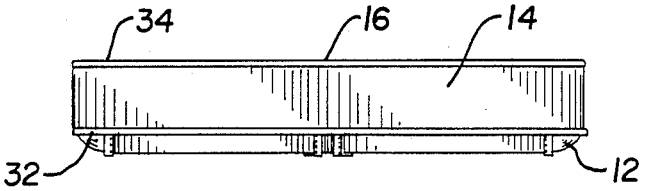
FIG. 7 is a bottom plan view of FIG. 3.
Figure 9:
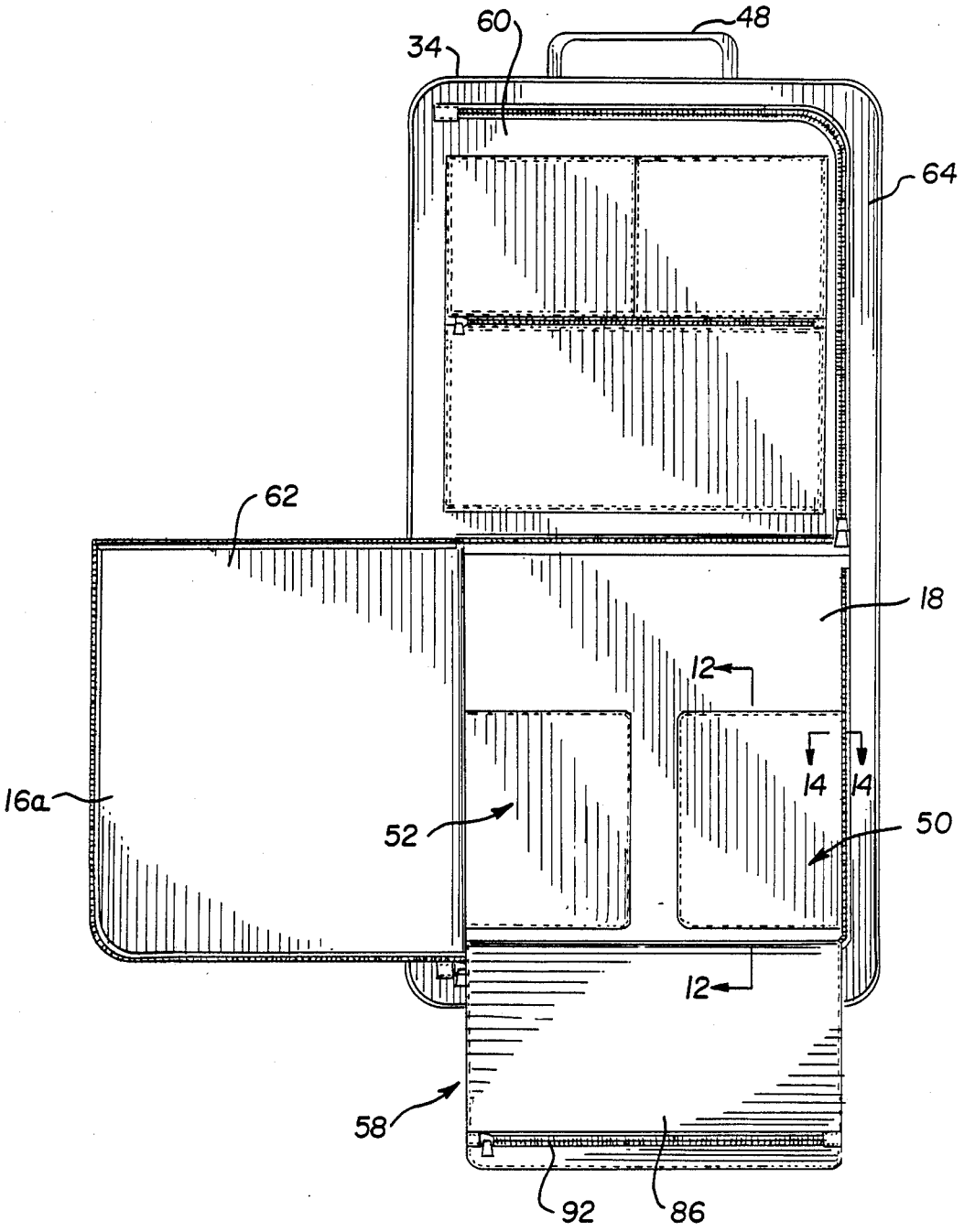
FIG. 9 is an elevational view similar to FIG. 8 with a bottom flap outside of a central chamber of the garment carrier bag.
Figure 10:
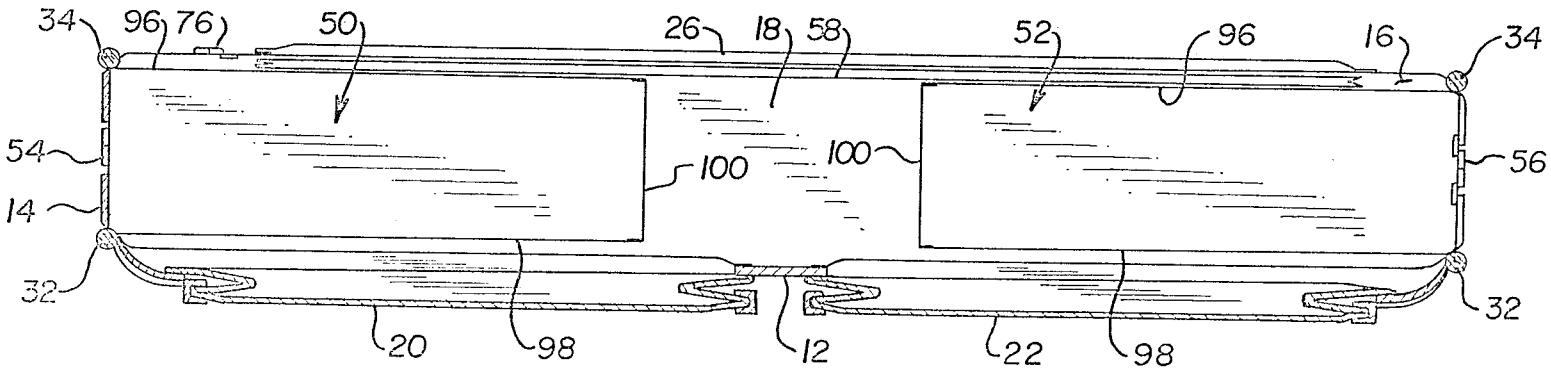
FIG. 10 is an enlarged sectional view taken along lines 10—10 of FIG. 3.
Figure 11:
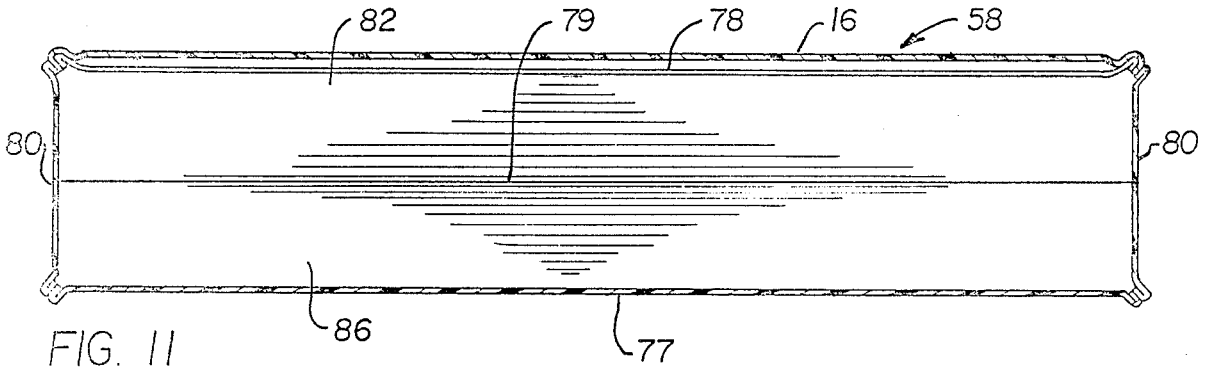
FIG. 11 is a sectional view taken along lines 11—11 of FIG. 8 showing the construction of flap means which is embodied in the invention.

Referring to FIG. 3, outer wall means 12 comprises, as mentioned earlier, pockets 20, 22, and 24 which may be constructed in a conventional manner, and which have access therein through slide fasteners 36, 38, 40 and 42 which may be of the zipper type, with slide fasteners 40 and 42 providing access into pocket 24. A handle assembly 44 is attached to bag 10 approximately midway along outer wall means 12 and is particularly used for carrying garment bag 10 when in its folded condition. This handle assembly 44 may be of a conventional type and attached in a conventional manner. Also, in a conventional fashion, an opened pocket 46 is provided adjacent pocket 24 as particularly shown to the top of FIG. 3 for carrying a hook element (not shown) which conventionally is affixed to the top of garment bag 10 through well-known means along gusset means 14 thereof, and which hook element is used for hanging garment carrier bag 10 over a rod or a top of a door. Referring especially to FIGS. 1 and 9, gusset means 14 has side pockets 50, 52 (FIG. 9) which are opened and closed by slide fasteners 54, 56 of FIGS. 4 and 5, respectively. Also affixed to the top of garment bag 10 and along gusset means 14 as particularly shown in FIG. 6, is a handle assembly 48 which may be used for carrying or handling garment bag 10 when in its unfolded disposition.

Figure 2:
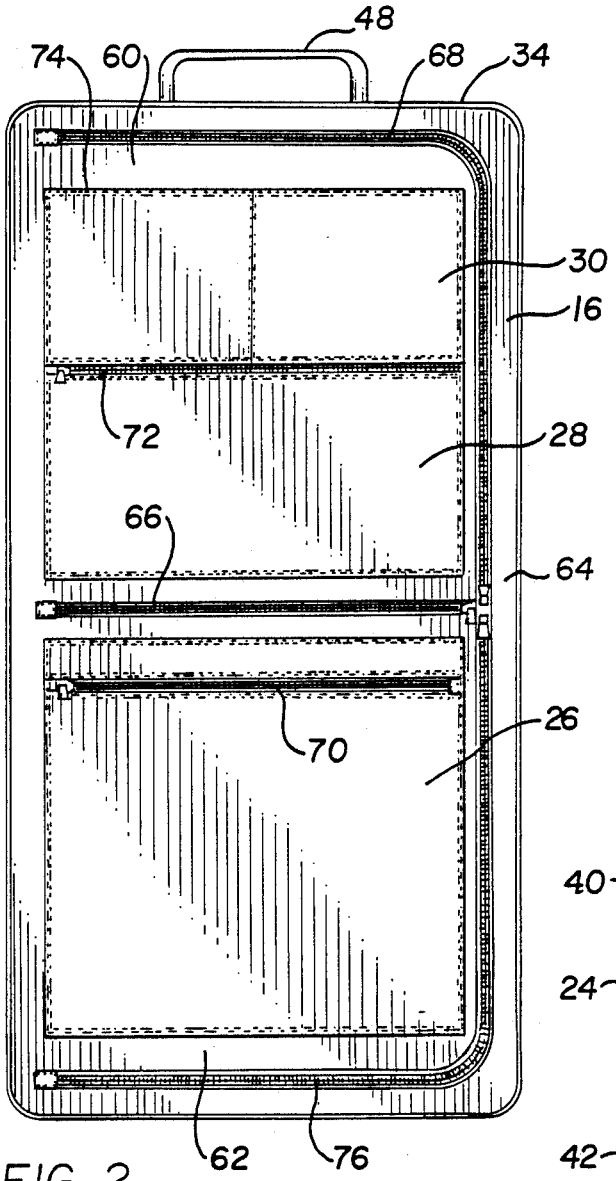
FIG. 2 is a front elevational view of one wall of the garment bag when in an unfolded disposition.
Figure 8:
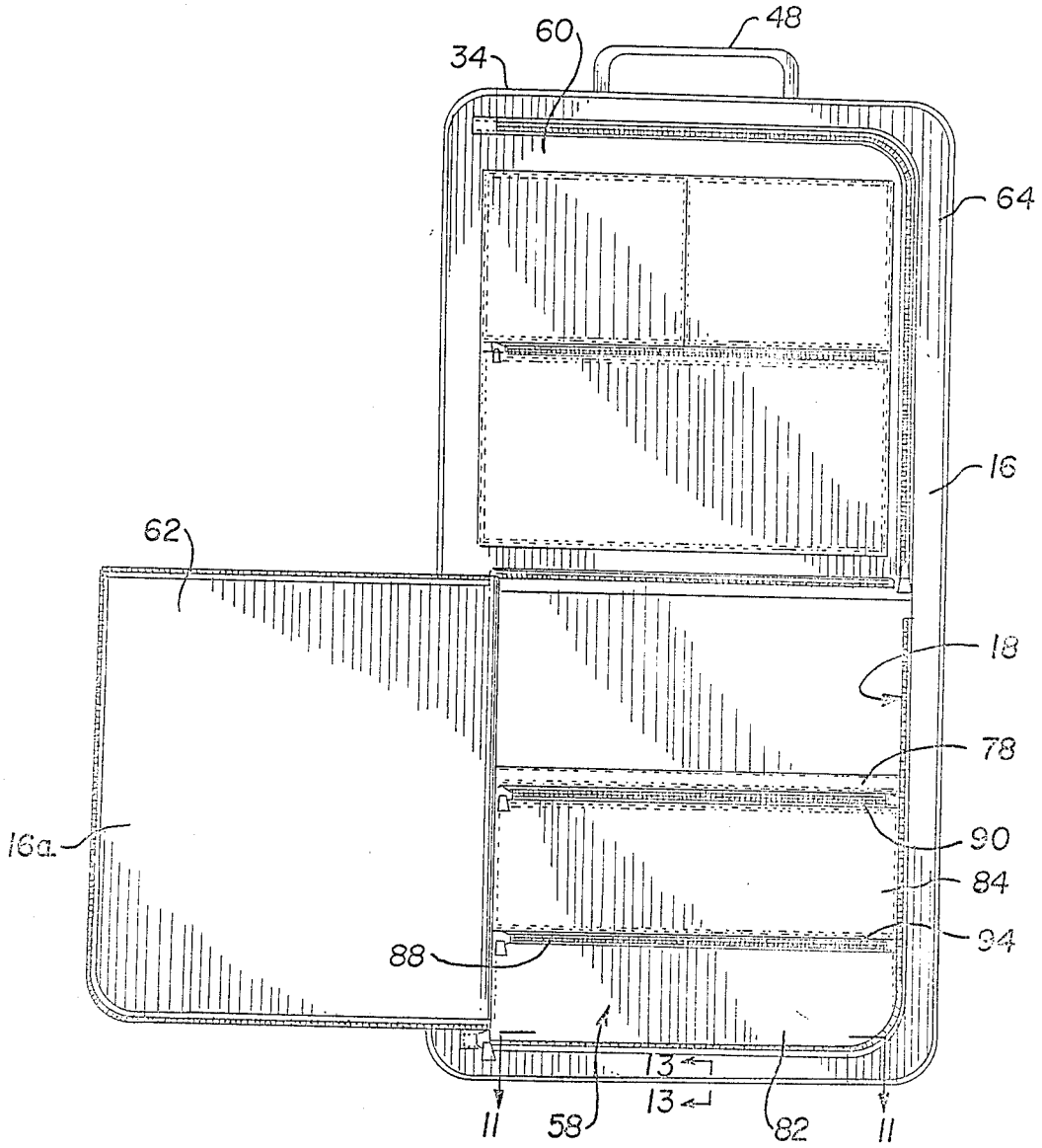
FIG. 8 is an elevational view similar to FIG. 1 with a bottom of an inner wall in an opened disposition.

The invention is particularly embodied in the inner wall means 16 as particularly shown in FIGS. 2, 8 and 9; flap means 58 as particularly shown in FIGS. 9, 10, 11, and 13 and side pockets 50, 52 as particularly shown in FIGS. 4, 5, 9, 10, 12, and 14.

Referring to FIG. 2, innerwall means 16 comprises an upper portion 60, a lower portion 62, and a peripheral portion 64 extending partially around upper portion 60 and lower portion 62. Pockets 26, 28, 30 are formed by stitching pieces of a sturdy flexible piece of material such as vinyl or plastic onto cooperating peripheral sections of upper portion 60 and lower portion 62 as shown in FIG. 2 where inner wall 16a becomes a wall for pockets 26, 28, 30, and which peripheral section 64 of portions 60, 62 may be the same type of material as pockets 26, 28, 30. Pockets 26, 28, 30 are opened and closed through slide fasteners 70, 72, 74, respectively which may be of the zipper type (FIG. 2).

Upper portion 60 and lower portion 62 of inner wall means 16 are fastened and unfastened relative to each other through operation of a slide fastener 66 (FIG. 2) which may be of the zipper type, with one part of the tape of the zipper fastener being stitched to an edge of upper portion 60 and the other tape part of the zipper fastener being stitched to an edge of the lower portion 62. Upper portion 60 is fastened and unfastened to peripheral portion 64 through slide fastener means 68 which may be of the zipper type where the two tapes of the zipper are each sewn on cooperative edges of upper portion 60 and peripheral portion 64. Similarly, lower portion 62 is fastened and unfastened to peripheral portion 64 through slide fastener means 76 whch may be of the zipper type, where the two tapes of the zipper are each sewn to cooperative edges of lower portion 62 and peripheral portion 64.

This particular construction of upper portion 60, lower portion 62, and peripheral portion 64 of inner wall means 16 with their respective slide fastener means 66, 68, 76 permits a partial opening of garment bag 10, and therefore access into a portion of central chamber 18, as particularly shown in FIGS. 8 and 9.

This features becomes better appreciated with regard to flap means 58 of thes FIGS. 8 and 9, wherein lower portion 62 of inner wall means 16 provides easy access to flap means 58, without having to completely open central chamber 18.

Flap means 58 is generally rectangular in shape and is made of sturdy, flexible material such as plastic, vinyl, or leather, and may be the same material as that of upper portion 60 and lower portion 62. Flap means 58 is attached in central chamber 18 along a lateral side of garment bag 10 by stitching it into the welting 34 (FIG. 13) along the seam between gusset means 14 and inner wall means 16 of garment bag 10. As particularly shown in FIG. 11, flap means 58 comprises outer wall 77, inner wall 78; and gusset 80 and is formed by stitching gusset 80 between and to inner wall 78 and outer wall 77. Gusset 80 extends generally around the three sides of the flap means 58, and does not extend along the edge of the flap means 58 sewn into the welting 34, where the outer wall 77 and inner wall 78 are brought together and sewn therein. Pockets 82, 84, 86 are formed in inner wall 78 and outer wall 77 by providing a dividing wall 79 (FIG. 11) sewn into the seamline along gusset 80 and outer wall 77, and by providing slide fasteners of the zipper type 88, 90, 92 respectively for opening and closing pockets 82, 84, 86. Outer wall 77 consists of a single pocket 86; whereas inner wall 78 consists of two pockets 82, 84 which are individually formed by stitching across flap means 58 as indicated by stitch line 94 (FIG. 8), which runs parallel to the stitch line for slide fastener 88.

As FIGS. 8 and 9 show, flap means 58 can be made to lay inside central chamber 18 (FIG. 8), or folded outside central chamber 18 (FIG. 9) for access therein.

Figure 4:
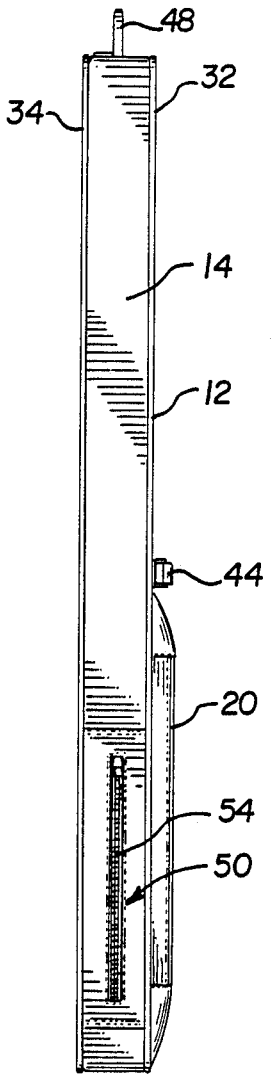
FIG. 4 is a left side view of FIG. 3.

Flap means 58 is of the collapsible type in that gusset 80 is folded along its center line which then allows for expansion depending upon the bulk of its contents. Adjacent to flaps means 58 are pockets 50 and 52. As mentioned previously, access into pockets 50 and 52 is made on the outside of garment bag 10 along gusset means 14. A generally rectangular opening which is smaller than that of pockets 50, 52 in cross section (more about which will be discussed herein) is made in gusset means 14 and the cooperative tape parts of slide fasteners 54, 56 respectively are attached onto gusset means 14 such as by stitches along these openings (FIGS. 4 and 5).

Figure 12:
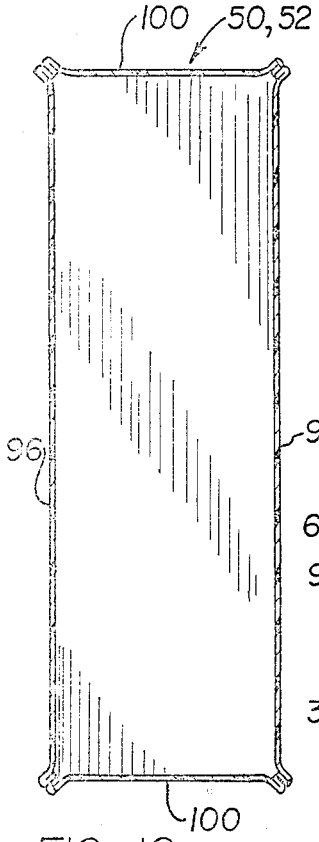
FIG. 12 is a sectional view taken along lines 12—12 of FIG. 9 showing the construction of one of the pockets which are embodied in the invention.
Figure 14:
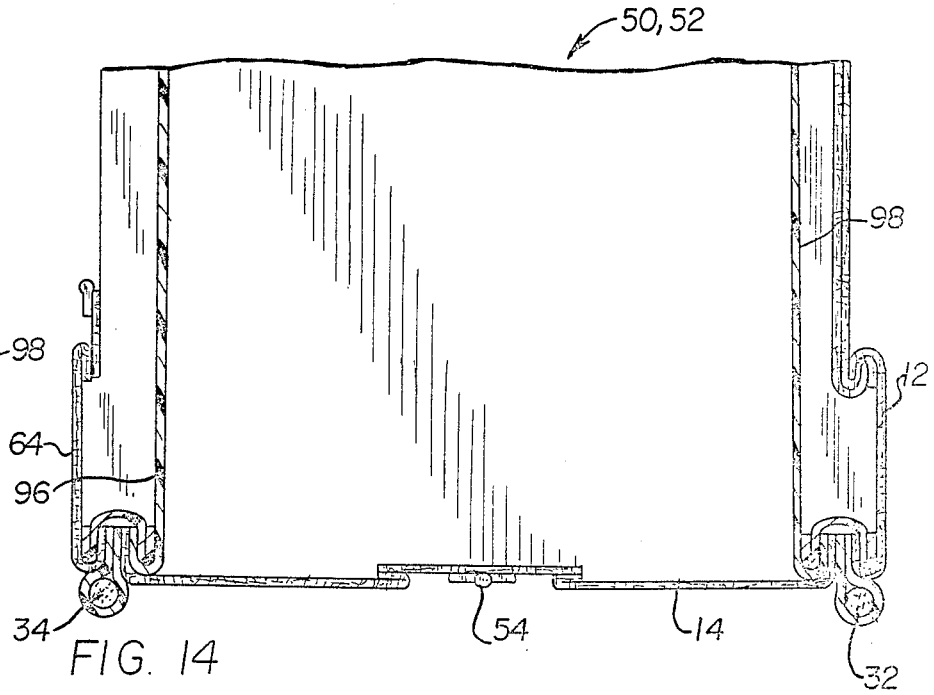
FIG. 14 is a sectional view taken along lines 14—14 of FIG. 9 and shows the manner in which one of the side pockets is secured into the welting on opposed peripheral sides of the garment bag.
Figure 13:
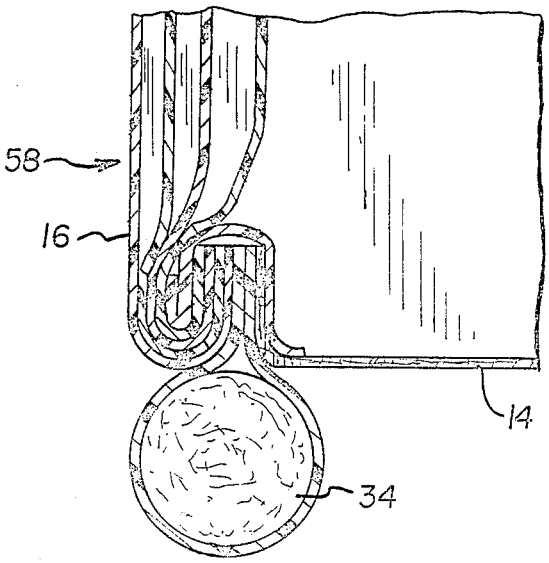
FIG. 13 is a sectional view taken along lines 13—13 of FIG. 8 and shows the manner in which the flap means is sewn into the welting at the bottom of the garment bag.

Both pockets 50, 52 are similarly constructed and affixed in central chamber 18 of garment bag 10, however, the description for both pockets 50, 52 will be given with reference to pocket 50. Pocket 50 as shown in FIGS. 12 and 14, includes outer wall 96, inner wall 98 and gusset member 100 between outer wall 96 and inner wall 98 giving depth to pocket 50. Gusset member 100 is attached, for example, by stitches along at least three sides of the periphery of outer wall 96 and inner wall 98 to generally form a rectangular pocket 50 as particularly seen in FIG. 9 with an opening along the fourth side thereof. From FIG. 12, it can be seen that a cross section of pocket 50 is generally a rectangular shape. As FIG. 14 shows, the two longitudinal edges of the opening for pocket 50 is affixed, for example by stitching, into welting 32, 34 along the opposed longitudinal peripheral sides of garment bag 10, and the two lateral edges of the opening for pocket 50 are affixed to gusset means 14 of garment bag 10 across its width by means such as stitches indicated at number 110 located near the ends of slide fastener 54 for pocket 50, particularly seen in FIG. 1.

Pockets 50, 52 are made generally of a flexible, durable material, such as vinyl, plastic or leather and may be of the same type of material as that for flap means 58, and inner wall means 16 of garment bag 10.

The construction of pockets 50, 52 is similar to that of flap means 58 in that they are of the collapsible type wherein they can be folded along centerline of gusset member 100 and expand in the central chamber 18 depending on the bulk of their contents.

These pockets 50, 52 are conveniently located and accessible by the user and can be used to carry personal items, such as shoes or toiletries without having to enter the main central chamber 18. Both flap means 58 and pockets 50, 52 allow room at the bottom of garment bag 10 for the hanging garments and/or other articles of clothing or toiletries being carried in central chamber 18.

As FIG. 1 indicates, pockets 50, 52 and flap means 58 are located behind pockets 20, 22. As is evident in the drawings, when garment bag 10 is unfolded and is to be hung up, pockets 50, 52 and flap means 58 are located toward the bottom of garment bag 10, with the hook element used for hanging garment bag 10 being located at the top of garment bag 10 near handle 48 (FIG. 9). This location also provides easy access into pockets 50, 52 and flap means 58 even when garment bag 10 is in a hanging disposition.

Whereas a particular embodiment of the invention has been described above for purposes of illustration, it will be evident to those skilled in the art that numerous variations of the details may be made without departing from the invention as defined in the appended claims.

I claim:

1. A foldable, flexible walled garment carrier bag having in an open, extended condition a longitudinal dimension and a transverse dimension, and comprising in said open, extended condition thereof:

a longitudinally extending rear wall, sidewalls around the periphery of said rear wall and a front wall opposing said rear wall and connected to said sidewalls, a seamline between said rear wall and said sidewalls, and a seamline between said front wall and said sidewalls, said rear wall, said front wall, and said sidewalls forming a central chamber having a garment hanging section at one longitudinal end thereof, said rear wall providing access into the interior of said central chamber, opposed side pockets located along said sidewalls in said longitudinal dimension on opposing sides of said garment bag and extending into said central chamber, said pockets partially attached along said seamline of said sidewalls and said rear wall, partially attached along said seamline of said sidewalls and said front wall, and partially attached laterally across said sidewalls, said pockets having means for opening and closing thereof located along said sidewalls outside said garment bag for easy access therein, and flap means consisting of a plurality of pockets, and being attached to the bottom of said garment bag along said transverse dimension into said seamline between said sidewalls and said rear wall at a longitudinal end opposite to said one longitudinal end of said garment bag and inside said central chamber and capable of being extended out of said central chamber or being placed in said central chamber adjacent to said opposed pockets, said flap means being formed by a gusset member of flexible material, a front wall of flexible material attached to said gusset member, and a rear wall of flexible material attached to said gusset member, said plurality of pockets of said flap means located on both said rear and front walls and being formed by a dividing wall between said rear and front walls and secured to said gusset member.

2. A foldable garment bag according to claim 1, wherein each said opposed side pocket comprises:

a U-shape chamber with an opening which is generally rectangular in cross section and is longitudinally disposed along an associated section of said sidewall;

said U-shape chamber having a gusset member being of flexible material, and a front and rear flexible wall sewn to said gusset member and being the same material as said gusset member, said gusset member being substantially the same width as said sidewalls of said garment bag.

3. A foldable garment bag according to claim 2, wherein said garment bag consists of welting along said seamlines, wherein each said side pocket has longitudinal edges on opposite sides of its said opening and is sewn into said welting of said seamlines along its said longitudinal edges along its said opening; and wherein said means for opening and closing said each of said pockets is a slide fastener.

4. A foldable garment bag according to claim 1, wherein said rear wall of said garment bag has at least two portions capable of being separated and which face each other when said garment bag is folded, said two portions consisting of separation means for allowing separation of said two portions relative to each other and separation from said rear wall thereby allowing said access into said central chamber and whereby a first of said two portions provides access into said central chamber and to said flap means without operating said separation means of a second of said two portions.

5. A foldable garment bag according to claim 1, wherein said plurality of pockets of said flap means each consists of slide fasteners for opening and closing said pockets and wherein said each pocket and slide fastener of said flap means extends across and are substantially the same length as said flap means, which length is substantially parallel to said transverse dimension of said garment bag.

6. A foldable garment bag according to claim 1, wherein said garment bag consists of welting along said seamlines, wherein said flap means is sewn along one of its edges into said welting, and substantially extends along said transverse dimension of said garment bag.

7. A foldable, flexible walled garment carrier bag having in an open, extended condition a longitudinal dimension and a transverse dimension, and comprising in said open, extended condition thereof:

a longitudinally extending rear wall, sidewalls around the periphery of said rear wall and a front wall opposing said rear wall and connected to said sidewalls, a seamline between said rear wall and said sidewalls, and a seamline between said front wall and said sidewalls, said rear wall, said front wall, and said sidewalls forming a central chamber having a garment hanging section at one longitudinal end thereof, said rear wall providing access into the interior of said central chamber, and flap means consisting of a plurality of pockets, and being attached to the bottom of said garment bag along said transverse dimension into said seamline between said sidewalls and said rear wall at a longitudinal end opposite to said one longitudinal end of said garment bag, and inside said central chamber and capable of being extended out of said central chamber, said flap means being formed by a gusset member of flexible material, a front wall of flexible material attached to said gusset member, and a rear wall of flexible material attached to said gusset member, said plurality of pockets of said flap means located on both said rear and front walls and being formed by a dividing wall between said rear and front walls and secured to said gusset member.

8. A foldable garment bag according to claim 7, wherein said plurality of pockets of said flap means each consists of slide fasteners for opening and closing said pockets and wherein said each pocket and slide fastener of said flap means extends across and are substantially the same length as said flap means, which length is substantially parallel to said transverse dimension of said garment bag.

9. A foldable, flexible walled garment carrier bag having in an open, extended condition a longitudinal dimension and a transverse dimension, and comprising in said open, extended condition thereof;

a longitudinally extending rear wall, sidewalls around the periphery of said rear wall and a front wall opposing said rear wall and connected to said sidewalls, a seamline between said rear wall and said sidewalls, and a seamline between said front wall and said sidewalls, said rear wall, said front wall, and said sidewalls forming a central chamber having a garment hanging section at one longitudinal end thereof, said rear wall providing access into the interior of said central chamber, opposed side pockets located at a longitudinal end opposite to said one longitudinal end of said garment bag along said sidewalls in said longitudinal dimension on opposing sides of said garment bag and extending into said central chamber, said pockets partially attached along said seamline of said sidewalls and said rear wall, partially attached along said seamline of said sidewalls and said front wall, and partially attached laterally across said sidewalls, said pockets having means for opening and closing thereof along said sidewalls outside said garment bag for easy access therein, and flap means consisting of a plurality of pockets, and being attached to the bottom of said garment bag along said transverse dimension into said seamline between said sidewalls and said rear wall at said longitudinal end of said garment bag inside said central chamber and capable of being extended out of said central chamber or being placed in said central chamber adjacent to said opposed pockets, said rear wall of said garment bag having an upper portion and a lower portion capable of being separated from each other and which face each other when said garment bag is folded, said upper and lower portions consisting of separation means for allowing separation of said two portions relative to each other along said transverse dimension and separation from said rear wall first along said longitudinal dimension and then along said transverse dimension thereby allowing said access into said central chamber, and whereby said lower portion is capable of being opened outwardly to provide access into said central chamber towards said bottom of said garment bag and to said flap means without operating said separation means of said upper portion from said rear wall, said side pockets and said flap means being of a flexible material and constructed such that said flap means is adapted to overlap said side pockets upon said placing of said flap means in said central chamber.

10. A foldable garment bag according to claim 9, wherein each said opposed side pocket comprises:

a U-shaped chamber with an opening which is generally rectangular in cross section and is longitudinally disposed along an associated section of said sidewall;

said U-shape chamber having a gusset member being of flexible material, and a front and rear flexible wall sewn to said gusset member and being the same material as said gusset member, said gusset member being substantially the same width as said sidewalls of said garment bag.

11. A foldable garment bag according to claim 10, wherein said garment bag consists of welting along said seamlines, wherein each said side pocket has longitudinal edges on opposite sides of said opening and is sewn into said welting of said seamlines along its said longitudinal edges of its said opening; and wherein said means for opening and closing said each of said pockets is a slide fastener.

12. A foldable garment bag according to claim 9, wherein said garment bag consists of welting along said seamlines, wherein said flap means is sewn along one of its edges into said welting, and substantially extends along said transverse dimension of said garment bag.

13. A foldable garment bag according to claim 12, wherein said flap means is formed by a gusset member of flexible material, a front wall of flexible material attached to said gusset member, and a rear wall of flexible material attached to said gusset member, and wherein said plurality of pockets of said flap means are located on both said rear and front walls and are formed by a dividing wall between said rear and front walls and secured to said gusset member.

14. A foldable garment bag according to claim 13, wherein said plurality of pockets of said flap means each consists of slide fasteners for opening and closing said pockets and wherein said each pocket and slide fastener of said flap means extends across and are substantially the same length as said flap means, which length is substantially parallel to said transverse dimension of said garment bag.

* * * * *

UNITED STATES PATENT AND TRADEMARK OFFICE

CERTIFICATE OF CORRECTION

PATENT NO. : 4,825,985

DATED : May 2, 1989

INVENTOR(S) : Hyun S. Kim

It is certified that error appears in the above-identified patent and that said Letters Patent is hereby corrected as shown below: Title page:

In the References Cited, "4,030,268" should be --4,030,768--.

In the Summary Of The Invention, column 1, line 46, "havng" should be --having--.

In the Description Of A Preferred Embodiment, column 2, line 40, "bay" should be --bag--; column 4, line 3, "features" should be --feature--; column 4, line 4, "thes" should be --these--.

Claim 9, column 7, line 36, the semicolon should be a colon; line 61, after "thereof" insert --located--.

Claim 10, column 8, line 26, change "U-shaped" to --U-shape--.

Signed and Sealed this

Third Day of October, 1989

*Attest:*

*Attesting Officer*

DONALD J. QUIGG

*Commissioner of Patents and Trademarks*